US010602845B2

(12) United States Patent
Mason et al.

(10) Patent No.: US 10,602,845 B2
(45) Date of Patent: Mar. 31, 2020

(54) CUSTOMIZABLE CAMP CHAIR COVER

(71) Applicant: Walmart Apollo, LLC, Bentonville, AR (US)

(72) Inventors: Jennifer Mason, Bentonville, AR (US); Mary Billingsley McDaniel, Bentonville, AR (US)

(73) Assignee: Walmart Apollo, LLC, Bentonville, AR (US)

( * ) Notice: Subject to any disclaimer, the term of this patent is extended or adjusted under 35 U.S.C. 154(b) by 0 days.

(21) Appl. No.: 16/137,535

(22) Filed: Sep. 20, 2018

(65) Prior Publication Data

US 2019/0090643 A1 Mar. 28, 2019

Related U.S. Application Data

(60) Provisional application No. 62/562,235, filed on Sep. 22, 2017.

(51) Int. Cl.

| | |
|---|---|
| ***A47C 4/30*** | (2006.01) |
| ***A47C 7/46*** | (2006.01) |
| ***A47C 7/14*** | (2006.01) |
| ***A47C 4/54*** | (2006.01) |
| ***A47C 4/28*** | (2006.01) |

(52) U.S. Cl.

CPC ..... *A47C 4/30* (2013.01); *A47C 4/28* (2013.01); *A47C 4/286* (2013.01); *A47C 4/54* (2013.01); *A47C 7/142* (2018.08); *A47C 7/467* (2013.01)

(58) Field of Classification Search

CPC .. A47C 4/30; A47C 4/54; A47C 7/142; A47C 7/467; A47C 27/08; A47C 27/14; A47C 27/15; A61G 7/057; A61G 7/05769; A61G 7/05776

USPC ..... 297/19

See application file for complete search history.

(56) References Cited

U.S. PATENT DOCUMENTS

| | | | |
|---|---|---|---|
| 4,687,452 | A | 8/1987 | Hull |
| 6,382,729 | B1 | 5/2002 | Wu |
| 6,446,282 | B1 | 9/2002 | Wu |
| 6,814,408 | B2 | 11/2004 | Chen |
| 8,783,781 | B1 | 7/2014 | McClure et al. |
| 2004/0232756 | A1 | 11/2004 | Lin |
| 2007/0001505 | A1 | 1/2007 | Marshall et al. |
| 2011/0025111 | A1 | 2/2011 | Wornell et al. |

(Continued)

FOREIGN PATENT DOCUMENTS

| | | | |
|---|---|---|---|
| DE | 102009052738 | A1 | 5/2011 |
| WO | 9614783 | A1 | 5/1996 |

OTHER PUBLICATIONS

Machine Translation of DE102009052738 (Year: 2009).*

(Continued)

*Primary Examiner* — Mark R Wendell

(57) ABSTRACT

Systems herein provide a customizable camp chair cover that may provide additional functional features and/or aesthetic elements to portable seating. In some examples, portions of the camp chair cover are inflatable and/or receive inserted inflation devices for customized support at various areas of seating when attached to the chair. Portions of the camp chair cover may be configured to provide access to portions of the chair and/or accessories. The camp chair cover may also be customized to provide team logos, designs, colors, and other aesthetic elements.

18 Claims, 7 Drawing Sheets

(56) References Cited

U.S. PATENT DOCUMENTS

| | | | |
|---|---|---|---|
| 2013/0328362 | A1 | 12/2013 | Miller |
| 2014/0346836 | A1 | 11/2014 | Briggs et al. |

OTHER PUBLICATIONS

Copenheaver, Blain R., "International Search Report", International Application No. PCT/US2018/052096, dated Dec. 6, 2018, 2 pages.
Copenheaver, Blain R., "Written Opinion", International Application No. PCT/US2018/052096, dated Dec. 6, 2018, 7 pages.

* cited by examiner

CUSTOMIZABLE CAMP CHAIR COVER

BACKGROUND

A portable chair, or camp chair, typically provides portable seating in a minimal form factor. A camp chair may expand and contract in order to collapse for storage and transport. Generally, a camp chair comprises a frame with permanently attached fabric that serves as a seat and back of the chair, and often the frame will include two arm rests as well.

SUMMARY

Examples of this disclosure provide a customizable camp chair cover that may provide additional functional features and/or aesthetic elements to portable seating. In some examples, portions of the camp chair cover are inflatable to provide customized support at various areas of seating when the cover is attached to the chair. In other examples, portions of the camp chair cover are configured to receive inserted inflation devices for customized support at various areas of seating when attached to the chair. In still other examples, portions of the camp chair cover are configured to provide access to portions of the chair and/or accessories of the chair when the chair is covered by the chair cover.

BRIEF DESCRIPTION OF THE DRAWINGS

Corresponding reference characters indicate corresponding parts throughout the drawings.

DETAILED DESCRIPTION

Examples of the disclosure provide a customizable camp chair cover that provides interchangeable options for updating either or both of the functionality and aesthetic appearance of a portable chair, or camp chair. In one example, the customizable camp chair cover is an inflatable cover that has ergonomically placed air pockets along portions of the cover configured to provide adjustable support that can be adjusted to a desired level of firmness. The air pockets, or inflatable portions, of the chair cover add extra levels of comfort to portable seating when the cover is placed on the chair. One or more areas of the inflatable chair cover may be adjusted, either individually or together, to achieve a desired level of inflation. With easy inflation, the chair cover quickly and easily provides the support and comfort desired when paired with a portable chair.

The inflatable portions may be individual cells or chambers built into the chair cover to provide support and comfort in various configurations and locations. Each individual cell or chamber may be inflated alone, a plurality of cells or chambers may be inflated simultaneously, and/or a portion of a plurality of individual cells may be inflated individually while another portion of the plurality of individual cells may be inflated together, or any combination of the preceding.

The inflatable portions may be deflated in various customizable configurations as well. In some examples, a single deflation component may allow air flow to exit the one or more inflatable chambers of the chair cover. In other examples, one or more deflation components may be associated with one or more individual cells or air chambers to allow air to escape in some areas of the chair cover while maintaining inflation in other areas of the chair cover. In some examples, a deflation component may forcibly remove air from one or more inflated areas of the chair cover. A deflation component may be, for example, a knob, button, nozzle, removable seal, vacuum, or any other suitable component for controlling air flow into and/or out of an inflatable portion.

In other examples, the chair cover may provide an alternate or interchangeable appearance for the portable chair. The portable chair material may have fading or be worn in areas, or be in a color that is no longer desirable, or have logos, mascots, or other insignia that is no longer desirable or is temporarily undesirable. In these examples, the chair cover may be used to alter the appearance of the portable chair while maintaining use of the functionality provided by the portable chair.

Figure 1A:
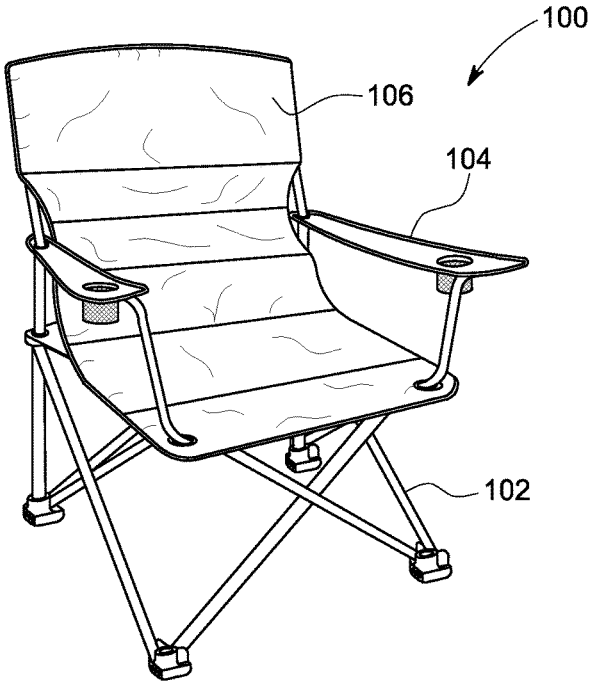
FIG. 1A is an exemplary diagram illustrating a portable chair without a cover in accordance with the disclosure.

Referring to FIG. 1A, an exemplary diagram illustrates a known portable chair without a chair cover. Chair 100 includes a frame 102. The frame 102 may be an expandable and contractible structure, such as a collapsible frame for a portable chair. Frame 102 may include arm rests 104. Seat 106 is coupled to or affixed to frame 102 to provide a surface area with bottom and back support. Seat 106 may be comprised of any suitable fabric or material.

Figure 1B:
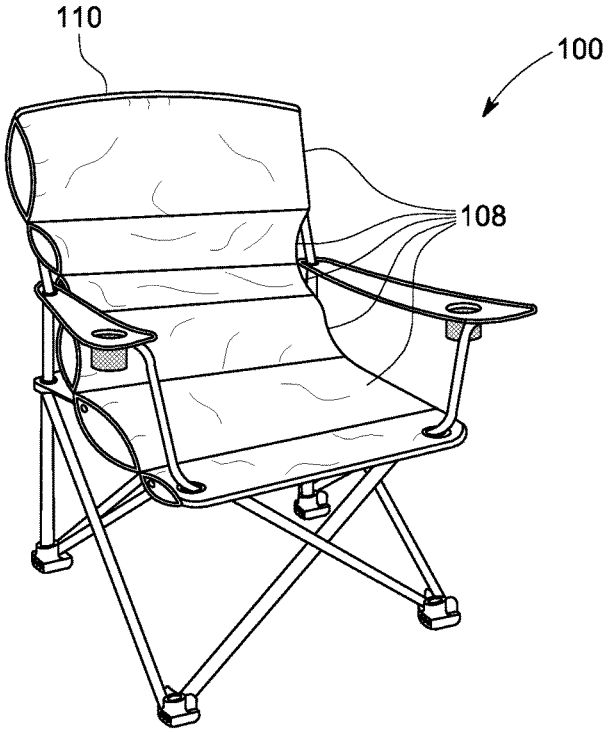
FIG. 1B is an exemplary diagram illustrating an inflatable chair cover for a portable chair in accordance with the disclosure.

FIG. 1B is an exemplary diagram illustrating an inflatable chair cover implemented on a portable chair, with the inflatable cover in an inflated state. An inflated state may refer to a state in which at least some air is contained and/or maintained within one or more of the inflatable portions. The inflated state may have various degrees of inflation, such that customizable levels of air pressure, or inflation, may be achieved in one or more of the inflatable portions. A deflated state may refer to a state in which substantially no air is contained or maintained within one or more of the inflatable portions. It should be understood that a deflated state may comprise a threshold level of air within an inflatable portion, however the air may not be forcibly maintained or contained in the deflated state.

Chair cover 110 may be disposed on, affixed to, or otherwise attached to chair 100. In some examples, chair cover 110 may be disposed along the portion of the seat, such as seat 106, that is front-facing, that is the portion on which a person may set when using the chair. Chair cover 110 may substantially cover the front-facing portion of the chair, while being secured to or affixed to the chair along an edge, side or back portion, for example with a cinching element or fastening element. Chair cover 110 may include inflatable portions and uninflatable portions, in some examples. Chair cover 110 is depicted with inflatable portions 108 in an inflated state. The inflatable portions 108 may be comprised at least in part of a compressible material that is impervious to penetration by air, such that air flow or other fluids may be maintained within a sealed enclosure formed by the material. The material may be any type of material, or any combination of materials, such as nylon, polyester, polyethylene, impregnated fabric, coated fabric, or any other suitable textile or material, for example.

In some examples, each inflatable portion of the inflatable portions 108 may have an individual valve disposed at an outer location, or at an outer layer, along the inflatable portion. The valve is an air flow control component that provides for adjustment of air flow to a corresponding portion or number of portions. In other examples, an individual inflatable portion may have one or more air chambers, and a valve may control air flow to the one or more air chambers. In some other examples, an electric pump may include an automatic fill valve and tube connected to the inflatable portions that would fill each inflatable portion and/or air chambers of the inflatable portions.

The valve may be implemented at a location of an inflatable portion opposite to or away from a surface are location that may be in contact with a user when the user is seated. For example, the valve or number of valves may be located at a back side of the chair cover relative to the front of a seating area, or underneath a seat portion of the chair cover, or at a side of the chair cover, or any other suitable location.

The inflatable portions may be individually separated to provide customizable levels of inflation in each portion, in some examples. In other examples, one or more inflatable portions may be internally connected to allow air flow between the connected inflatable portions, with internal structures that provide configurable air support to each of the inflatable portions.

The inflatable chair cover may be comprised of a compressible material that is impervious to penetration by air, such that air or other fluids may be maintained within a sealed enclosure formed by the material. The material may be any type of material, such as nylon, polyester, polyethylene, impregnated fabric, coated fabric, or any other suitable material for example.

Inflatable chair cover may include an outer layer and an inner layer of material, in some examples, with one or more air chambers or air pockets formed by an enclosure of the inner layer and baffling elements disposed within. One or more inflation means may also be disposed between the inner layer and outer layer. The inflation means may further be connected to a valve disposed on the outer layer on one end and a valve disposed on the inner layer at another end, in some examples, to provide for air flow from outside the air chambers to flow into the air chambers, and vice versa. In some examples, air may be compressibly forced out of inflatable portions of the inflatable chair cover.

In other examples, the inflatable chair cover may be configured with insertable regions to receive inflatable inserts. The insertable regions, or insertion points, of the chair cover may be configured as a pocket having an opening at one end, or as a sleeve having an opening at opposite ends, to allow for insertion of insertable elements, for example. One or more inflatable inserts may be inflated to a desired level and inserted into a space or opening, such as insert pockets, of the inflatable chair cover. The inflatable inserts may be deflated and compressed for storage when not in use. In some examples, a pouch or other pocket may be incorporated into the fabric or material of the chair cover to accommodate an inflatable insert in an inflated state. Optionally, a pouch or other pocket for accommodating one or more inflatable inserts in a deflated state may be incorporated into the fabric of material of the chair cover, or alternatively disposed along the frame of the chair at some location in order to maintain the inflatable inserts in proximity to the chair and/or chair cover when not in use.

Inflatable inserts may include valves to control air flow into and out of the inflatable inserts using any suitable means. The valves may be any type of device or component configured to control the direction and/or characteristics of air flow into or out of, or both into and out of, an enclosed chamber of an inflatable insert. Valves may include an open state and a closed state, where the open state allows air flow and the closed state prevents air flow, for example.

In some examples, a valve may be a knob that constricts or allows air flow. In other examples, a valve may be a removable seal. In still other examples, a valve may be a nozzle that provides for self-inflation of an inflatable insert when in an open state, maintains inflation of the inflatable insert when in a closed state, and when combined with compression allows air to escape for deflation when in an open state. For example, an inflatable insert may include one or more self-inflating chambers coupled to a valve, each air chamber being separately adjustable once inflated to reduce air pressure in individual air chambers where desired in order to customize the inflation level of various portions of the inflatable insert.

In other examples, one or more of the inflatable regions may be connected to a shared air flow control system, allowing the connected regions to be inflated simultaneously. In some examples, the air flow control system may provide for simultaneous inflation but individual deflation of a set of shared inflatable regions. For example, a valve or nozzle may be implemented or disposed at a portion of a first region, and one or more air chambers of the first region may be at least partially connected to a second region, whereby the introduction of air into the first region provides air flow through the first region to the second region. In other examples, inflation may occur simultaneously in two or more regions, with deflation configured to occur separately in each region using an air flow control system to allows air into all chambers at once but provides for air flow out of the chambers individually.

One or more baffling elements may be disposed within the interior portion of the inflatable regions, forming cells or chambers that divide the interior inflatable portion of the inflatable regions, for example. In other examples, individual air chambers may be relatively sealed off from each other and include a small channel disposed or implemented between the individual air chambers to control air flow between the chambers.

The inflatable chair cover may include uninflatable portions as well, such as along the edges where the material connects to or wraps around the portable chair frame, or is connected to the portable chair, or along optional arm rests, or any other suitable area.

The air flow control may be a knob, dial, nozzle, seal, plug, and/or any other suitable means of controlling air flow. In the example of a knob or nozzle, the air flow control may be configured to turn one way to provide an open state and the opposite way to provide a closed state. In these examples, air flow may be manually controlled by the air flow controls implemented on the inflatable portions.

Figure 2:
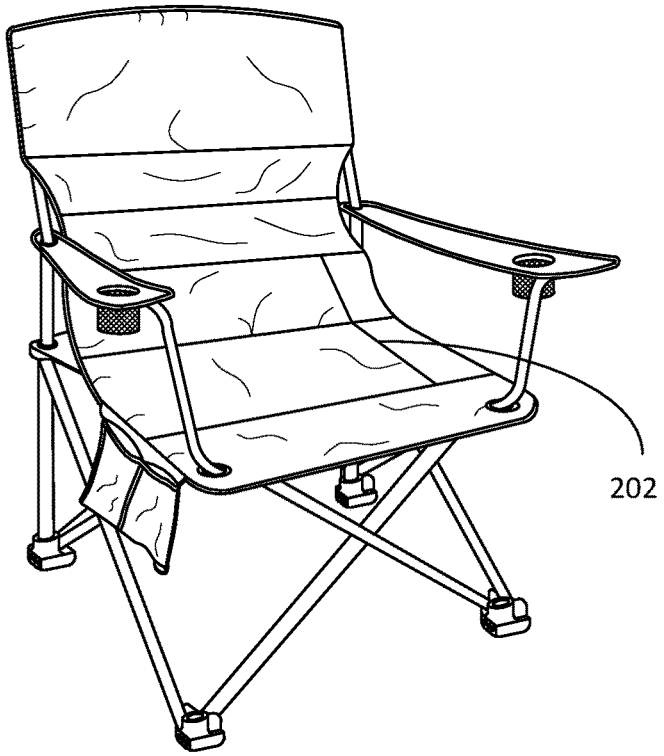
FIG. 2 is an exemplary diagram illustrating a customizable chair cover for a portable chair in accordance with the disclosure.

FIG. 2 illustrates a customizable chair cover for a portable chair in accordance with the disclosure. In some examples, the chair cover may cover portions of the portable chair, while other portions of the portable chair remain uncovered. For example, the chair cover may cover the seat material, arm rests, and a portion of the frame for the portable chair, such as a slipcover style chair cover, but may leave uncovered a lower portion of the frame, legs, or feet of the portable chair.

In other examples, the chair cover may cover substantially all of the portable chair down to the feet of the frame. In other examples, the chair cover may have slots, slits, openings, or other access points and/or ports to allow the arm rests of the portable chair to be exposed when other portions of the portable chair are covered by the chair cover. The chair cover may fit over an entire seat portion with openings for the arm rests, in some examples, or may cover the arm rests as well in other examples.

The chair cover may have a slit or slot or other access point 202 or opening to accommodate access of a camp chair blanket affixed to or fastened to the underlying portable chair and accessible via the cover when the portable chair is covered by the chair cover, in some examples. This may provide access to other functionality or accessories of the portable chair without having to remove the chair cover.

The chair cover may be configured to allow for inflation and deflation of an inflatable camp chair, in some examples, without having to remove the cover from the inflatable chair. In other examples, an inflatable chair cover may be connected with an inflatable camp chair in order to control inflation of the inflatable chair, or to allow inflation of the chair cover by inflatable controls of the inflatable chair.

Figure 3:
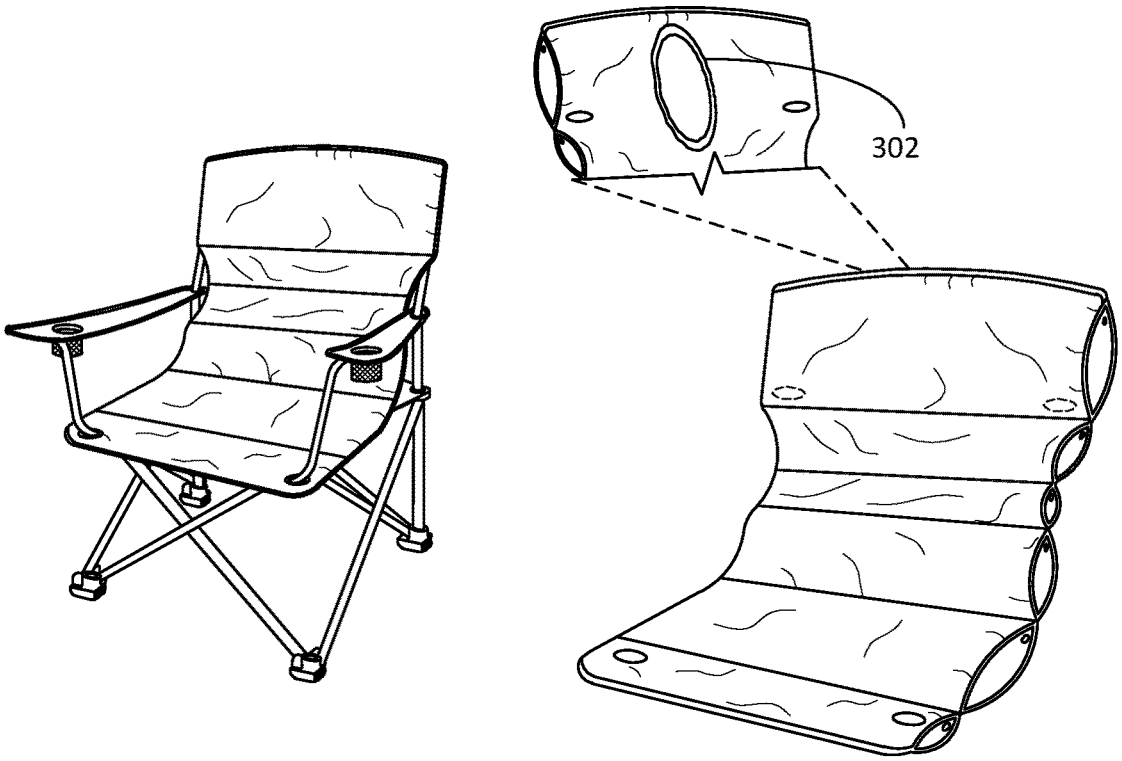
FIG. 3 is an exemplary diagram illustrating a chair cover for a portable chair in accordance with the disclosure.

FIG. 3 illustrates a portable chair cover configured for a portable chair. The cover may have openings or access points to provide for structural elements of the portable chair to pass through the cover, such as frame elements forming arm rests for example. The portable chair cover may include an elastic band 302 affixed to the circumference of a back portion of the cover and configured to hold the cover in place around the seat material of the portable chair.

Figure 4A:
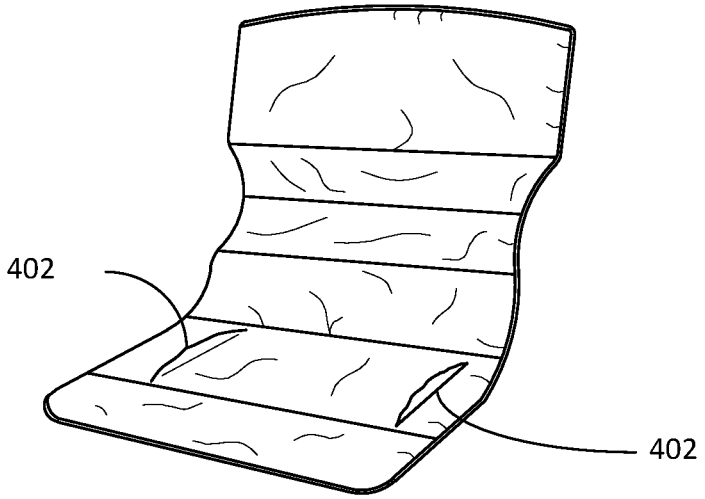
FIG. 4A is an exemplary diagram illustrating a front view of a chair cover for a portable chair in accordance with the disclosure.

FIG. 4A illustrates a front view of a chair cover for a portable chair. The chair cover may have slits, slots, or openings 402 along a portion of the cover that aligns with frame elements of a portable chair, such as arm rests, to allow the chair cover to fit over the chair while allowing the arm rests to pass through the cover. In this example, the cover may be disposed around substantially all of the front portion of seating material of the portable chair and at least a portion of the back of the seating material for the portable chair.

Figure 4B:
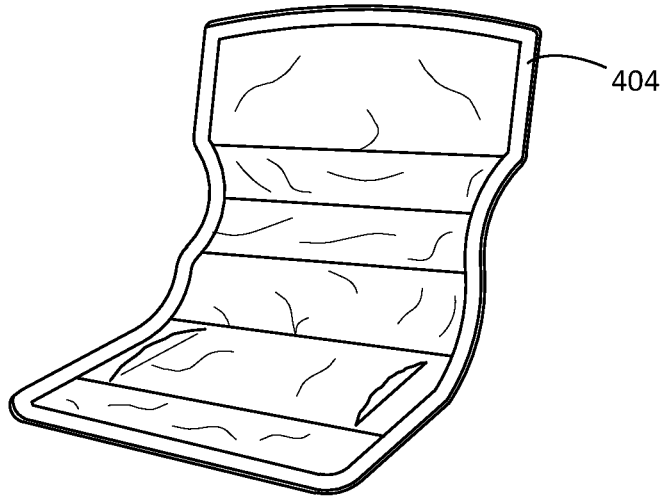
FIG. 4B is an exemplary diagram illustrating a back view of a chair cover for a portable chair in accordance with the disclosure.

FIG. 4B illustrates a back view of a chair cover for a portable chair. An elastic band 404 may be affixed to the material of the chair cover along a circumference of the back side of the cover in order to provide means to hold the cover in place over the existing chair frame or chair seating material.

Figure 5:
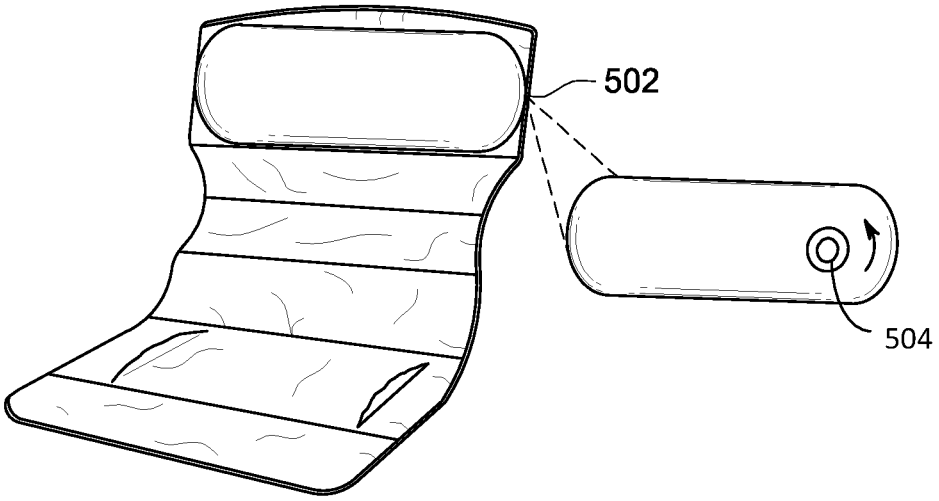
FIG. 5 is an exemplary diagram illustrating an inflatable portion of a chair cover for a portable chair in accordance with the disclosure.

FIG. 5 is an exemplary diagram illustrating an inflatable portion of a chair cover for a portable chair in accordance with the disclosure. As illustrated in the diagram, inflatable portion 502 may be an inflatable portion of a chair cover. The other areas of the chair cover may be uninflatable in this example, providing both an inflatable portion and an uninflatable portion for the chair cover. The inflatable portion may have a valve 504 to control air flow into that portion of the chair cover. As an example, a chair cover may have an inflatable head rest. Although a single inflatable portion is depicted for illustrative purposes, it will be understood from the disclosure that any number of individual inflatable portions may be included in the customizable chair cover.

Figure 6:
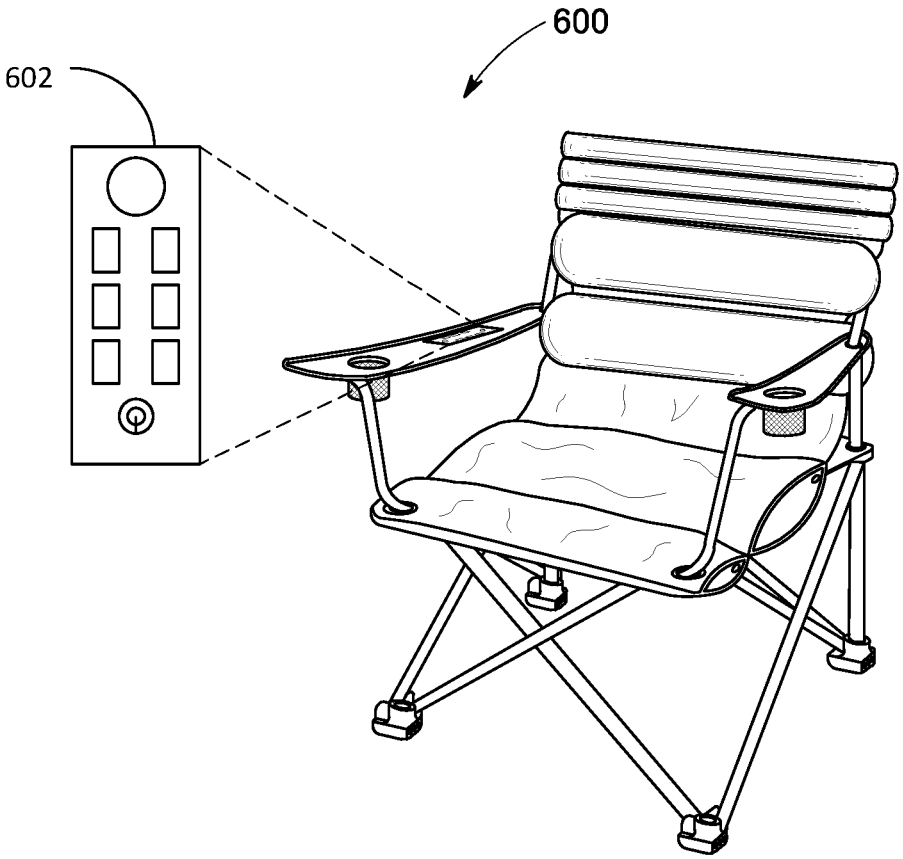
FIG. 6 is an exemplary diagram illustrating a customizable control of an inflatable chair cover for a portable chair.

FIG. 6 is an exemplary diagram illustrating a customizable control of an inflatable portable chair cover. Chair cover 600 may be an illustrative example of inflatable chair cover 106 implemented on chair 100 in FIGS. 1A and 1B.

Chair cover 600 may include customizable controls 602 implemented remote from the inflatable portions and communicatively coupled to air flow controls that are in physical communication with the inflatable portions. Customizable controls may be used to selectively inflate and/or deflate one or more different inflatable regions of chair cover 600, for example.

In some examples, chair cover 600 includes one or more motors disposed in each insertable region and communicatively coupled to the customizable controls in order to receive signals from the controls and control air flow in response to the received signals. In other examples, chair cover 600 includes one or more valves communicatively coupled to the customizable controls and configured to receive signals and control the air flow in response to the signals received. In yet other examples, chair cover 600 may include one or more valves for inflation, and customizable controls may be used to selectively deflate one or more regions or portions of the chair cover after full inflation of all regions to achieve a desired inflation level at various portions of the chair cover. The customizable controls may include buttons, dials, levers, switches, and/or any other suitable control.

Figure 7:
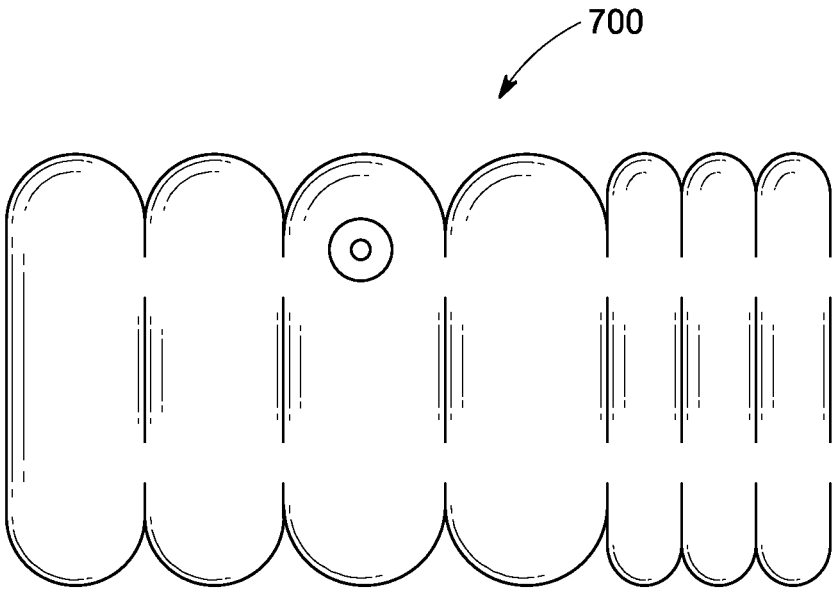
FIG. 7 is an exemplary diagram illustrating an interior portion of an inflatable chair cover for a portable chair in accordance with the disclosure.

FIG. 7 is an exemplary diagram an interior portion of an inflatable chair cover for a portable chair. Inflatable chair cover 700 may be an illustrative example of chair cover 110 in FIG. 1B, for example.

Inflatable chair cover 700 may include multiple air chambers disposed within the inflatable portion with an air flow control system configured to control air flow into and out of the air chambers. In this example, individual chambers of the inflatable portion may be in fluid communication with each other to allow air flow to pass through one chamber and into another chamber, for example.

Figure 8:
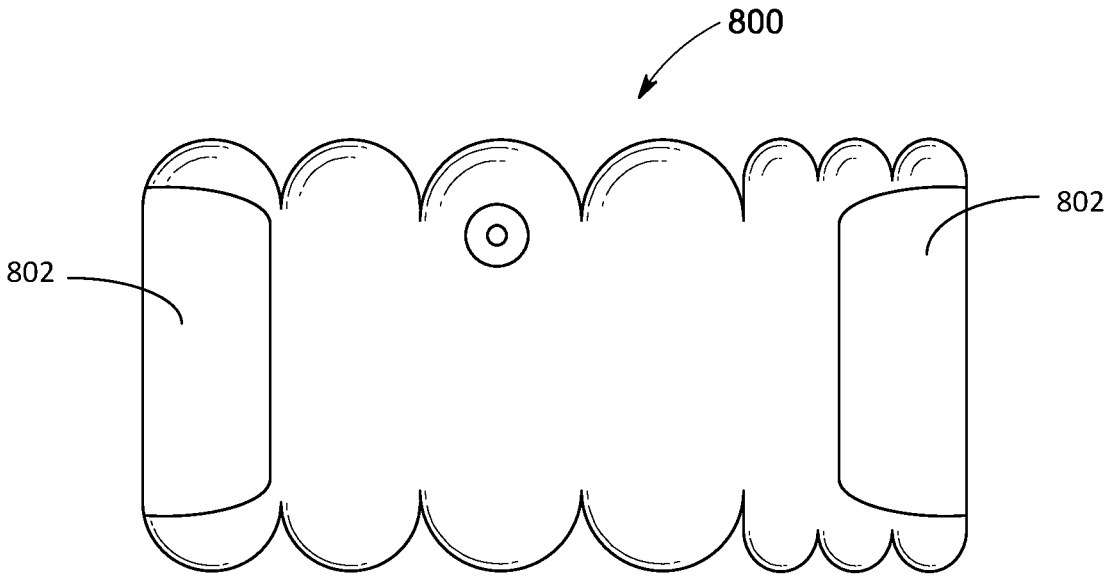
FIG. 8 is an exemplary diagram illustrating an exterior portion of an inflatable chair cover for a portable chair in accordance with the disclosure.

FIG. 8 is an exemplary diagram illustrating an exterior portion of an inflatable chair cover for a portable chair. Chair cover 800 includes a number of customizable inflation regions, and air flow control system, and attachment means 802 for coupling or attaching the chair cover to a portable chair. The attachment means may be non-inflatable regions of chair cover 800 that are configured to wrap around frame elements of the portable chair to hold the chair cover in place on the portable chair. Fasteners may be implemented in conjunction with the attachment means. Fasteners may include any suitable fastening means, such as, without limitation, Velcro, snap, button, tie, adhesive, hook and loop closure, zipper, or any other suitable type of fastener.

Figure 9:
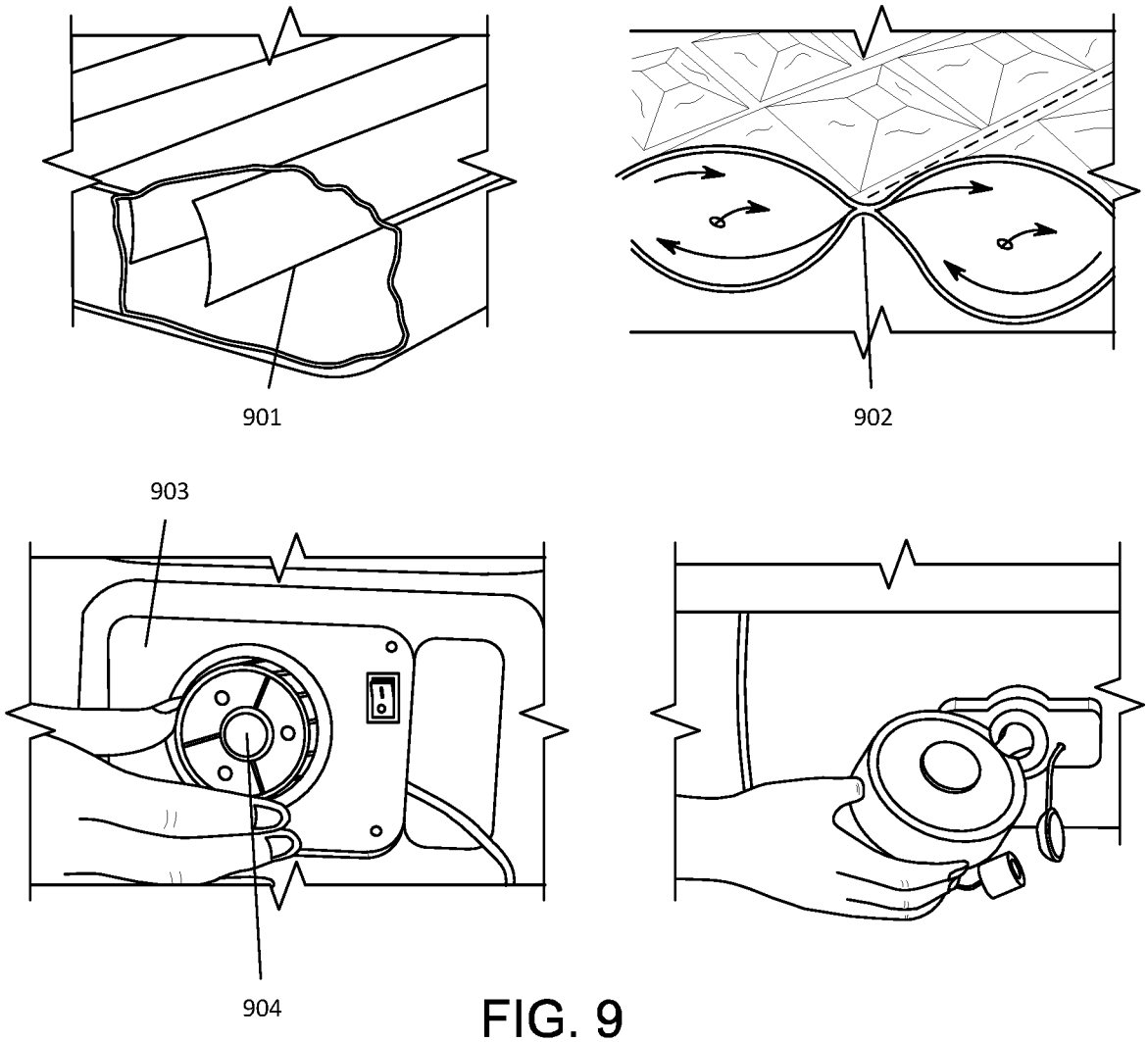
FIG. 9 is an exemplary diagram illustrating options for controlling inflation of an inflatable chair cover in accordance with the disclosure.

FIG. 9 is an exemplary diagram illustrating options for controlling inflation of an inflatable chair cover in accordance with the disclosure. As discussed above, the interior region of inflatable portions of the chair cover, or inflatable inserts for the chair cover configured with insertable regions, may include a number of baffling elements 901 in some examples to provide separable air chambers and control air flow throughout the interior region of the inflatable portions. In other examples, seams or seals 902 may provide separation between different air chambers of the inflatable portions or inflatable inserts. Air flow from one chamber to another chamber may be controlled by an inflation system implemented within the inflatable portions, in some examples.

The air flow control system of the inflatable chair cover may be configured to interact with an air pump, a motorized pump, a hand pump, a compressor, or any other suitable means of introducing air into the inflatable regions. In some examples, the air flow control system 903 may be integrated with the chair cover or the inflatable regions of the chair cover. The air flow control system may include a dial 904 to control inflation levels of various inflatable regions. In some examples, the dial may provide configurable settings for different regions in order to customize the introduction of air into that selected region when powered on. In other examples, the dial may provide configurable settings for different levels of inflation or air pressure in order to customize the amount of air introduced into inflatable regions. A power source may be implemented in the air flow control system, in some examples. In other examples, the air flow control system may have power connection or adapter means for connecting to an external power source. In still other examples, the air flow control system may be implemented as part of an inflatable portable chair with connection means that complement an air flow control component of the inflatable chair to provide air flow from the inflatable chair system to the inflatable chair cover.

Figure 10:
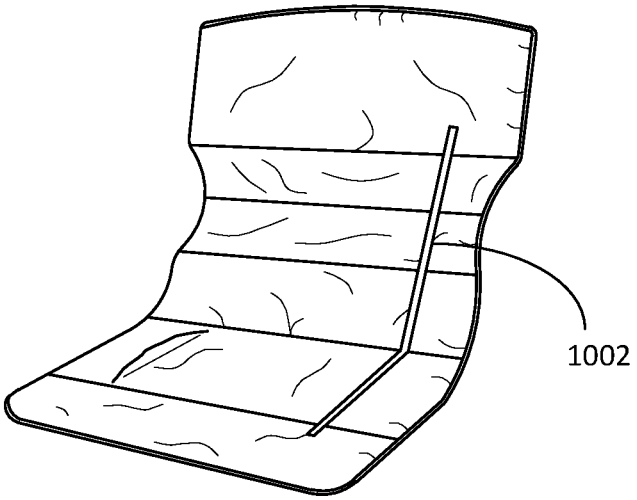
FIG. 10 is an exemplary diagram illustrating a chair cover for a chair having an attached blanket in accordance with the disclosure.

FIG. 10 is an exemplary diagram illustrating a chair cover for a chair having an attached blanket. In this example, chair cover 1000 may have an opening 1002 to provide access to a portion of the portable chair that is covered when the chair cover is on the chair. As one example, a portable chair may have a fastening system along a portion of the seat material configured to fasten a removable attachment, such as a blanket or other accessories. Example accessories include drapes or shields, which protect a user from moisture, sun exposure, cold, insects, and more. Additional accessories include an air pump that may be integrated into the camp chair and in some instances includes an electric motor. An opening in the chair cover may provide access to the fastening system to attach the removable attachment, or access for the removable attachment to pass through the opening and be used when the chair cover is on the chair.

Figure 11:
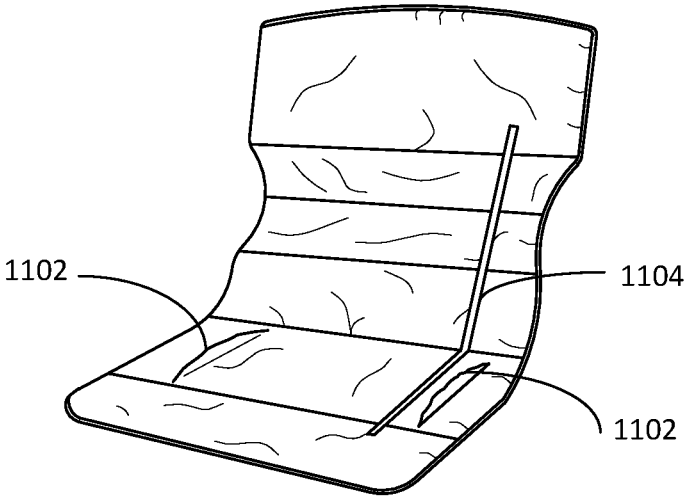
FIG. 11 is an exemplary diagram illustrating another chair cover for a chair having an attached blanket in accordance with the disclosure.

FIG. 11 is an exemplary diagram illustrating another chair cover for a chair having an attached blanket. In another example of a customizable portable chair cover, the chair cover may have access points or openings disposed along the material of the cover to provide for pass-through access for portions of the chair when the cover is on the chair. For example, a set of openings 1102 may be designed to allow existing arm rests and other chair elements associated with the arm rests to be visible and/or usable when the chair cover is covering the seat material of the chair. A separate opening 1104 may also be provided for accessories of the chair, such as a removably attached blanket or weather shield.

ADDITIONAL EXAMPLES

In some examples, the customizable chair cover may be configured in different sizes, in order to accommodate different size portable chairs in an interchangeable fashion. In other examples, the customizable chair cover may be configured using various materials to customize the look and feel of a portable chair. The various materials may include, without limitation, cotton, polyester, nylon, coated canvas, vinyl, suede, leather, fur, faux fur, microfiber, brushed fleece, and/or any other suitable material or combination of materials. The various materials may also be configured in any manner of design, color, and/or pattern. This provides for customization of a single chair for many different events or seasons as desired.

Alternatively, or in addition to the other examples described herein, examples include any combination of the following:

- a fastening system implemented on the removable chair cover and configured to couple the removable chair cover to the portable chair;
- wherein the one or more insertable regions is configured as a pocket having an opening at one end;
- wherein the one or more insertable regions is configured as a sleeve having an opening at two opposite ends;
- wherein the one or more insertable regions includes a fastening system configured to secure the one or more inserts within the one or more insertable regions;
- wherein at least one of the one or more inserts is an inflatable insert;
- wherein the customizable chair cover system includes an air control component communicatively couplable to the inflatable insert;
- wherein at least two of the one or more inserts are inflatable inserts that inflate simultaneously;
- wherein at least one of the one or more inserts is a drape;
- wherein the removable chair cover further includes an access point disposed along at least a portion of the material through which accessories of the portable chair may be accessed even as the removable chair cover is secured to the portable chair;
- wherein air pressure of at least one of the one or more inflatable regions is independently controllable;
- wherein at least one of the one or more inflatable regions is self-inflatable;
- an air pump configured to inflate at least one of the one or more inflatable regions;
- wherein the air pump is integrated into the removable chair cover;
- wherein the air pump includes an electric motor;
- a fastening system implemented on the removable chair cover;
- a removable attachment with a corresponding fastening system configured to couple with the fastening system implemented on the removable chair cover to secure the removable attachment to the removable chair cover;
- wherein the removable chair cover further comprises at least one opening disposed along a portion of the material to provide an access point through the removable chair cover to the portable chair even as the removable chair cover is secured to the portable chair.

When introducing elements of aspects of the disclosure or the examples thereof, the articles "a," "an," "the," and "said" are intended to mean that there are one or more of the elements. The terms "comprising," "including," and "having" are intended to be inclusive and mean that there may be additional elements other than the listed elements. The term "exemplary" is intended to mean "an example of" The phrase "one or more of the following: A, B, and C" means "at least one of A and/or at least one of B and/or at least one of C."

Having described aspects of the disclosure in detail, it will be apparent that modifications and variations are possible without departing from the scope of aspects of the disclosure as defined in the appended claims. As various changes could be made in the above constructions, products, and methods without departing from the scope of aspects of the disclosure, it is intended that all matter contained in the above description and shown in the accompanying drawings shall be interpreted as illustrative and not in a limiting sense.

What is claimed is:

1. A customizable chair cover system comprising:

one or more inserts; and a removable chair cover configured to cover a portable chair having a foldable rigid frame in an open position, the removable chair cover including a material forming one or more insertable regions, the one or more insertable regions configured to house the one or more inserts, wherein the removable chair cover further includes an access point disposed along at least a portion of the material through which accessories of the portable chair may be accessed even as the removable chair cover is secured to the portable chair.

2. The customizable chair cover system of claim 1 further comprising:

a fastening system implemented on the removable chair cover and configured to couple the removable chair cover to the portable chair.

3. The customizable chair cover system of claim 1 wherein the one or more insertable regions is configured as a pocket having an opening at one end.

4. The customizable chair cover system of claim 1 wherein the one or more insertable regions is configured as a sleeve having an opening at two opposite ends.

5. The customizable chair cover system of claim 1 wherein the one or more insertable regions includes a fastening system configured to secure the one or more inserts within the one or more insertable regions.

6. The customizable chair cover system of claim 1 wherein at least one of the one or more inserts is an inflatable insert.

7. The customizable chair cover system of claim 6 further comprising:

an air control component communicatively couplable to the inflatable insert.

8. The customizable chair cover system of claim 1 wherein at least two of the one or more inserts are inflatable inserts that inflate simultaneously.

9. The customizable chair cover system of claim 1 wherein at least one of the one or more inserts is a drape.

10. A customizable chair cover system comprising:

a removable chair cover configured to cover a portable chair having a foldable rigid frame in an open position, the removable chair cover including a material forming one or more inflatable regions, wherein the removable chair cover further comprises at least one opening disposed along a portion of the material to provide an access point through the removable chair cover to the portable chair even as the removable chair cover is secured to the portable chair; and an air control component communicatively coupled to at least one of the one or more inflatable regions.

11. The customizable chair cover system of claim 10 wherein air pressure of at least one of the one or more inflatable regions is independently controllable.

12. The customizable chair cover system of claim 10 wherein at least one of the one or more inflatable regions is self-inflatable.

13. The customizable chair cover system of claim 10 further comprising:

an air pump configured to inflate at least one of the one or more inflatable regions.

14. The customizable chair cover system of claim 13 wherein the air pump is integrated into the removable chair cover.

15. The customizable chair cover system of claim 13 wherein the air pump includes an electric motor.

16. The customizable chair cover system of claim 10 further comprising:

a fastening system implemented on the removable chair cover; and a removable attachment with a corresponding fastening system configured to couple with the fastening system implemented on the removable chair cover to secure the removable attachment to the removable chair cover.

17. The customizable chair cover system of claim 16 wherein the removable attachment is a drape.

18. A customizable chair cover comprising:

a material configured to removably cover a portable chair having a foldable rigid frame, the material forming one or more insertable regions, wherein the one or more insertable regions are configured to house one or more inflatable inserts in an inflated state;

a fastening system implemented on the material and operable to secure the material to the portable chair; and at least one access point disposed along a portion of the material through which accessories of the portable chair may be accessed even as the material is secured to the portable chair.

* * * * *